US011394125B2

(12) United States Patent
Sur et al.

(10) Patent No.: US 11,394,125 B2
(45) Date of Patent: Jul. 19, 2022

(54) RECONFIGURABLE ANTENNA DESIGN FOR CENTIMETER-WAVE AND MILLIMETER-WAVE

(71) Applicant: University of South Carolina, Columbia, SC (US)

(72) Inventors: Sanjib Sur, Cayce, SC (US); Guoan Wang, Irmo, SC (US); Srihari Nelakuditi, Columbia, SC (US)

(73) Assignee: University of South Carolina, Columbia, SC (US)

( * ) Notice: Subject to any disclaimer, the term of this patent is extended or adjusted under 35 U.S.C. 154(b) by 92 days.

(21) Appl. No.: 16/999,391

(22) Filed: Aug. 21, 2020

(65) Prior Publication Data

US 2021/0119346 A1 Apr. 22, 2021

Related U.S. Application Data

(60) Provisional application No. 62/924,436, filed on Oct. 22, 2019.

(51) Int. Cl.
*H01Q 1/24* (2006.01)
*H01Q 21/06* (2006.01)
(Continued)

(52) U.S. Cl.
CPC ..... *H01Q 21/065* (2013.01); *H01Q 1/243* (2013.01); *H01Q 1/38* (2013.01); *H01Q 9/0407* (2013.01)

(58) Field of Classification Search
CPC ..... H01Q 1/24; H01Q 1/241; H01Q 1/243; H01Q 1/38; H01Q 15/0066; H01Q 3/24;
(Continued)

(56) References Cited

U.S. PATENT DOCUMENTS 7,164,387 B2 * 1/2007 Sievenpiper ..... H01Q 1/243 343/700 MS
9,350,069 B2 * 5/2016 Pascolini ..... H01Q 1/243
(Continued)

OTHER PUBLICATIONS

Qualcomm Incorporated, "Qualcomm Announces 5G NR mmWave Prototype to Accelerate Mobile Deployments for Smartphones," 2017. [Online]. Available: https://www.qualcomm.com/news/releases/2017/09/11/qualcomm-announces-5g-nr-mmwave-prototype-accelerate-mobile-deployments.

(Continued)

*Primary Examiner* — Thai Pham
(74) *Attorney, Agent, or Firm* — Burr & Forman LLP

(57) ABSTRACT

A reconfigurable antenna apparatus may include an antenna assembly and control circuitry. The antenna assembly may include an antenna patch array having a plurality of antenna patches and a switch array having plurality of switches. Each switch of the plurality switches may be electronically controllable to transition between states including a conducting state and a non-conducting state. Each switch may be electrically connected between two of the antenna patches of the antenna array. The control circuitry may be configured to control the states of the switches of the switch array to operate the antenna patch array in a first communications mode at a first wavelength, and control the states of the switches of the switch array to operate the antenna patch array in a second communications mode at a second wavelength.

20 Claims, 17 Drawing Sheets

(51) Int. Cl.
*H01Q 1/38* (2006.01)
*H01Q 9/04* (2006.01)

(58) Field of Classification Search
CPC .... H01Q 5/364; H01Q 9/0407; H01Q 21/065; H01Q 21/06
See application file for complete search history.

(56) References Cited

U.S. PATENT DOCUMENTS

| | | | | |
|---|---|---|---|---|
| 10,374,309 | B2 * | 8/2019 | Sharawi | H01Q 9/0407 |
| 2019/0334228 | A1 * | 10/2019 | Haridas | H01Q 3/2694 |
| 2020/0154521 | A1 * | 5/2020 | Nguyen | H04W 88/08 |
| 2020/0313294 | A1 * | 10/2020 | Morita | H01Q 1/24 |

OTHER PUBLICATIONS

Sanjib Sur and Ioannis Pefkianakis and Xinyu Zhang and Kyu-Han Kim, "WiFi-Assisted 60 GHz Wireless Networks," in Proc. of ACM MobiCom, 2017. Available: https://dl.acm.org/doi/10.1145/3117811.3117817.

IEEE Standards Association, "IEEE Standards 802.11ad-2012, Amendment 3: Enhancements for Very High Throughput in the 60 GHz Band," 2012. [Online]. Available: http://standards.ieee.org/findstds/standard/802.11ad-2012.html.

Swetank Kumar Saha and Roshan Shyamsunder and Naveen Muralidhar Prakash and Hany Assasa abd Adrian Loch and Dimitrios Koutsonikolas and Joerg Widmer, "Poster: Can MPTCP Improve Performance for Dual-Band 60 GHz/5 GHz Clients?" in Proc. of ACM MobiCom, 2017.

Arunkumar Ravichandran and Ish Kumar Jain and Rana Hegazy and Teng Wei and Dinesh Bharadia, "Poster: Facilitating Low Latency and Reliable VR over Heterogeneous Wireless Networks," in Proc. of ACM MobiCom, 2018.

Ansys, Inc., "ANSYS HFSS: 3D Electromagnetic Field Simulator for RF and Wireless Design," 2018. [Online]. Available: https://www.ansys.com/products/electronics/ansys-hfss.

R. W. Heath Jr and N. G. Prelcic and S. Rangan and W. Roh and and A. Sayeed, "An Overview of Signal Processing Techniques for Millimeter Wave MIMO Systems," IEEE Journal of Selected Topics in Signal Processing, vol. 10, No. 3, 2016.

Ahmed Alkhateeb and Omar El Ayach and Geert Leus and Robert W. Heath , "Hybrid Precoding for Millimeter Wave Cellular Systems with Partial Channel Knowledge," in Information Theory and Applications Workshop, 2016.

Xiufeng Xie and Eugene Chai and Xinyu Zhang and Karthikeyan Sundaresan and Amir Khojastepour and Sampath Rangarajan, "Hekaton: Efficient and Practical Large-Scale MIMO," in Proc. of ACM MobiCom, 2015.

Jianhua Mo and Robert W. Heath, Jr., "High SNR Capacity of Millimeter Wave MIMO Systems with One-Bit Quantization," in Information Theory and Applications Workshop (ITA), 2014.

Charles Wu and Elad Alon and Borivoje Nikolic, "A Wideband 400 MHz-to-4 GHz Direct RF-to-Digital Multimode Delta Sum Receiver," IEEE Journal of Solid-State Circuits, vol. 49, No. 7, 2014.

Swetank Kumar Saha and Shivang Aggarwal and Rohan Pathak and Dimitrios Koutsonikolas and Joerg Widmer, "MuSher: An Agile Multipath-TCP Scheduler for Dual-Band 802.11ad/ac Wireless LANs," in Proc. of ACM MobiCom, 2019.

Stefan Parkvall and Erik Dahlman and Anders Furuskar and Mattias Frenne, "NR: The New 5G Radio Access Technology," IEEE Communications Standards Magazine, vol. 1, No. 4, 2017.

Ahmed Alkhateeb and Jianhua Mo and Nuria Gonzlez-Prelcic and and Robert W. Heath Jr., "MIMO Precoding and Combining Solutions for Millimeter-Wave Systems," IEEE Communications Magazine, vol. 52, No. 12, 2014.

* cited by examiner

RECONFIGURABLE ANTENNA DESIGN FOR CENTIMETER-WAVE AND MILLIMETER-WAVE

GOVERNMENT LICENSE RIGHTS

This invention was made with government support under 1253929 awarded by the National Science Foundation. The government has certain rights in the invention.

TECHNICAL FIELD

Example embodiments generally relate to antenna technologies and, more particularly, relate to apparatuses, systems, and methods for implementing a dynamically configurable antenna.

BACKGROUND

There is seemly no end to the desire to increase throughput of information in context of wireless communications. For example, with respect to cellular communications, technology has for merely voice communications to high speed data communications via 4th generation (4G) and now 5th generation (5G) technologies. To facilitate the evolution of these communications technologies, fundamental components of the communications devices must also evolve. Conventionally passive components, such as antennas, must also evolve to support new communications techniques.

BRIEF SUMMARY OF SOME EXAMPLES

According to some example embodiments, an example apparatus for implementing a reconfigurable antenna is provided. The example apparatus may comprise an antenna assembly. The antenna assembly may comprise an antenna patch array comprising a plurality of antenna patches, and a switch array comprising plurality of switches. Each switch of the plurality switches may be electronically controllable to transition between states comprising a conducting state and a non-conducting state. Additionally, each switch may be electrically connected between two of the antenna patches of the antenna array. The example apparatus may further comprise control circuitry configured to control the states of the switches of the switch array to operate the antenna patch array in a first communications mode at a first wavelength, and control the states of the switches of the switch array to operate the antenna patch array in a second communications mode at a second wavelength.

According to some example embodiments, an example method for configuring a reconfigurable antenna is provided. The example method may comprise controlling, via control circuitry, states of switches of a switch array to operate an antenna patch array in a first communications mode at a first wavelength. The antenna patch array may comprise a plurality of antenna patches and the switch array may comprise a plurality of switches. Each switch of the plurality switches may be electronically controllable by the control circuitry to transition between states comprising a conducting state and a non-conducting state. Additionally, each switch may be electrically connected between two of the antenna patches of the antenna array. The example method may further comprise controlling, via control circuitry, the states of the switches of the switch array to operate the antenna patch array in a second communications mode at a second wavelength.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
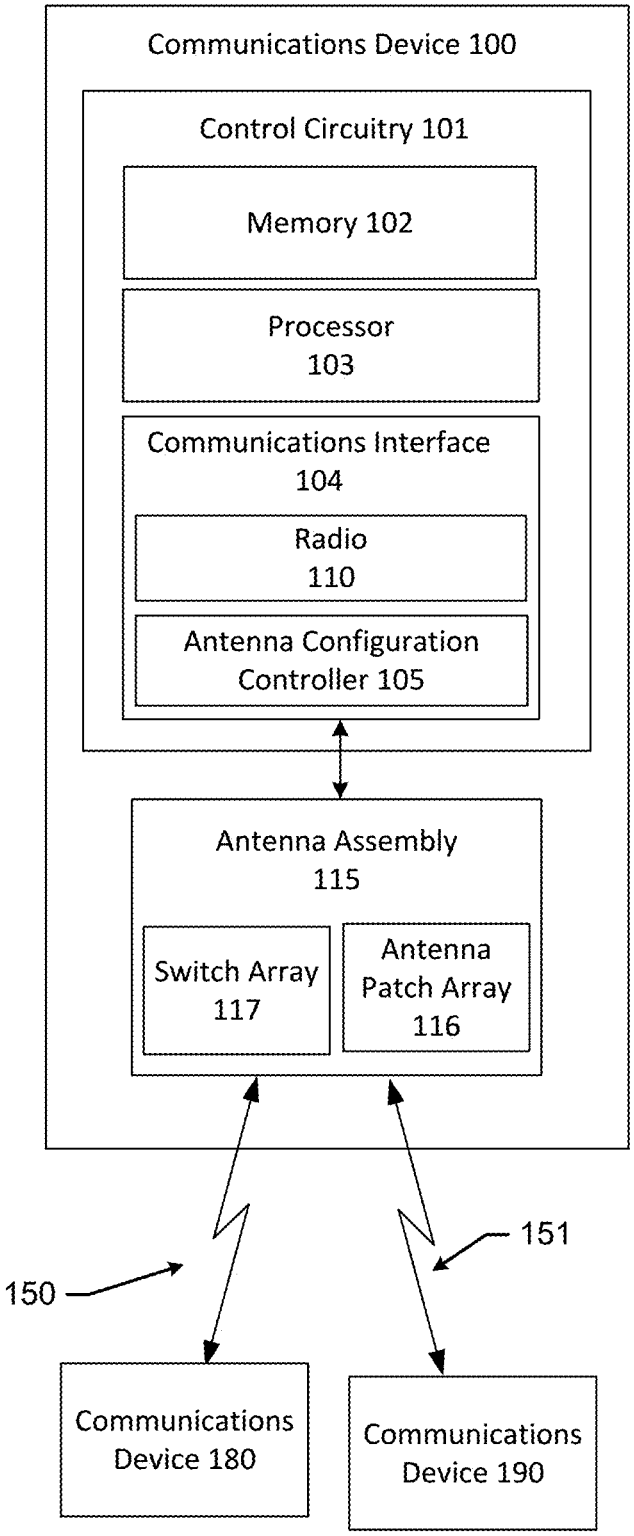
FIG. 1 illustrates an example communications device according to some example embodiments.

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout.

As used herein the term "or" is used as the logical or where any one or more of the operands being true results in the statement being true. As used herein, the phrase "based on" as used in, for example, "A is based on B" indicates that B is a factor that determines A, but B is not necessarily the only factor that determines A.

According to some example embodiments, apparatuses, systems, and methods are provided for implementing a reconfigurable antenna. The reconfigurable antenna may be controllable, according to some example embodiments, to operate in a first communications mode that supports communications at a first wavelength (or frequency) and in a second communications mode that supports communications at a second wavelength (or frequency). The first wavelength may be associated with a frequency between about 6 GHz and 24 GHz (also referred to as centimeter-wave) and the second wavelength may be associated with a frequency between about 24 GHz and 100 GHz (also referred to as millimeter-wave). The control circuitry and radio components that support the operation of the reconfigurable antenna (e.g., beam steering circuitry, analog to digital/digital to analog converter circuitry, other radio circuitry, and the like) may also be controllable to support operation of the antenna in both the first communications mode and the second communications mode, without requiring separate components to support operation in each mode. According to some example embodiments, the reconfigurable antenna may be referred to as a ReconMilli antenna.

According to some example embodiments, an example apparatus in the form of a reconfigurable antenna may comprise a plurality of antenna patches that may be formed into an patch antenna array. Switches may be disposed between the antenna patches that are configured to selectively connect some or all antenna patches to each other to change the communications mode of the reconfigurable antenna. The switches may be collectively referred to as a switch array comprising switches disposed between the various antenna patches. For example, a first antenna patch may have one or more switches that electrically connect an edge of the first antenna patch to an edge on a second antenna patch, that is adjacent to the first antenna patch. In some instances, more than one switch (e.g., two, three, etc.) may electrically connect the edge of the first antenna patch to the edge of the second antenna patch.

The switches may be individually controllable by a respective electric control signal, provided by control circuitry, that causes the switches to transition between a non-conducting state (e.g., open or off) or a conducting state (e.g., closed or on) to effectively change the physical dimensions of the reconfigurable antenna formed by the plurality of patches and allow for different communications modes. The switches may be embodied as, for example, transistors, microelectromechanical systems (MEMS) switches, diodes, or the like. Via control of the switches by the control circuitry, the physical dimension of the antenna formed by the plurality of antenna patches can be changed to support communications at different wavelengths (e.g., a first wavelength and a second wavelength) based on the states of the switches. As mentioned above, according to some example embodiments, the wavelengths for communications may be on the order of millimeter-wave communications with the switches in, for example, a first communications mode and associated configuration (e.g., all switches in the non-conducting state) and on the order of centimeter-wave with the switches in a second communications mode and associated configuration (e.g., all switches in the conducting state).

As mentioned above, there continues to be a need for antenna technology to evolve, particularly to support higher speed communications. For example, next-generation mobile devices, e.g., 5th generation (5G) and beyond, may be required to have spectrum flexibility capabilities to support improved communications. In other words, communications devices may be required to have the ability to operate across a wide-range or at different portions of the radio frequency spectrum, for example, from centimeter-wave (cmWave; colloquially, micro-wave) to millimeter-wave (mmWave). In some instances, 5G radio specifications have standardized PHY/MAC (physical layer/media access control) protocols for dual operations on centimeter-wave and millimeter-wave. Accordingly, antenna solutions, such as those described herein, may support such requirements and also cope with blockages from the user's hand, body, and various environmental objects. To do so, according to some example embodiments, reliable millimeter-wave connectivity can leverage, for example, an antenna with multiple millimeter-wave phased-array antennas accompanied by a fast transition to centimeter-wave connectivity.

Such requirements, can bring new challenges with regard to the physical space available on small, handheld mobile devices. In this regard, one fundamental challenge of implementing such antenna solution is implementing the solution in consideration of the limited physical space available to mobile devices. While coordination between centimeter-wave and millimeter-wave connectivity is a challenge, doing so in consideration of the limited physical space requirements is yet another that continues to be elusive. To address these and other challenges, according to some example embodiments, a reconfigurable antenna is provided herein. The reconfigurable antenna may be tunable to different frequencies (e.g., centimeter-wave, millimeter-wave, or the like) using a singular antenna assembly that is reconfigurable to support operation at different wavelengths and associated frequencies. In this manner, according to some example embodiments, an antenna assembly can be implemented with improved spectrum flexibility, while using reduced physical space for application with mobile devices.

According to some example embodiments, as described herein, a reconfigurable antenna may be implemented in the context of a wireless communications device. An example communications device 100 that may comprise and be configured to implement a reconfigurable antenna is shown in FIG. 1. The communications device 100 may be any type of wireless communications device, such as, for example, a mobile terminal or user equipment (e.g., smart phone), or a base station or other stationary wireless communications device. The communications device 100 may include, among other components, control circuitry 101 and an antenna assembly 115. The control circuitry 101 may include a memory 102, a processor 103, and a communications interface 104. The communications interface 104 may comprise a radio 110 and an antenna configuration controller 104. The antenna assembly 115 may include an antenna patch array 116 and a switch array 117.

As further described below, the control circuitry 101, and more specifically, the communications interface 104 may be configured to control the radio 110 and the antenna assembly 115 to transmit and receive wireless communications. In the regard, wireless communications links 150 or 151 may be established between the antenna assembly 115 and respective antennas of the communications devices 180 and 190. The communications links 150 and 151 may involve wireless signals at different frequencies or wavelengths and may be associated with different configurations of the antenna assembly 115. In this regard, the communication link 150 may be a centimeter-wave link and the communication link 151 may be a millimeter-wave link.

The control circuitry 101 may be configured to receive inputs and provide outputs in association with the various functionalities of the communications device 100. In this regard, the control circuitry 101 may comprise, for example, a memory 102, a processor 103, a communications interface 104. As components of the control circuitry 101, the communication interface 104 may comprise the radio 110 and antenna configuration controller 105. The control circuitry 101 may be operably coupled to other components of the communications device 100 or other components of a device that comprises the communications device 100.

Further, according to some example embodiments, control circuitry 101 may be in operative communication with or embody, the memory 102, the processor 103, and the communications interface 104. Through configuration and operation of the memory 102, the processor 103, and the communications interface 104, the control circuitry 101 may be configurable to perform various operations as described herein. In this regard, the control circuitry 101 may be configured to perform communications interface control and monitoring, support communications overhead, and manage remote communications, according to some example embodiments.

In some embodiments, the control circuitry 101 may be embodied as a chip or chip set. In other words, the control circuitry 101 may comprise one or more physical packages (e.g., chips) including materials, components or wires on a structural assembly (e.g., a baseboard). The control circuitry 101 may be configured to receive inputs (e.g., via peripheral components), perform actions based on the inputs, and generate outputs (e.g., for provision to peripheral components). In an example embodiment, the control circuitry 101 may include one or more instances of a processor 103, associated circuitry, and memory 102. As such, the control circuitry 101 may be embodied as a circuit chip (e.g., an integrated circuit chip, such as a field programmable gate array (FPGA)) configured (e.g., with hardware, software or a combination of hardware and software) to perform operations described herein.

In an example embodiment, the memory 102 may include one or more non-transitory memory devices such as, for example, volatile or non-volatile memory that may be either fixed or removable. The memory 102 may be configured to store information, data, applications, instructions or the like for enabling, for example, the functionalities described herein. The memory 102 may operate to buffer instructions and data during operation of the control circuitry 101 to support higher-level functionalities, and may also be configured to store instructions for execution by the control circuitry 101 and data that has been captured via, for example, a user interface or sensors. According to some example embodiments, such data may be generated based on other data and stored or the data may be retrieved via the communications interface 104 and stored.

As mentioned above, the control circuitry 101 may be embodied in a number of different ways. For example, the control circuitry 101 may be embodied as various processing means such as one or more processors 103 that may be in the form of a microprocessor or other processing element, a coprocessor, a controller or various other computing or processing devices including integrated circuits such as, for example, an ASIC (application specific integrated circuit), an FPGA, or the like. In an example embodiment, the control circuitry 101 may be configured to execute instructions stored in the memory 102 or otherwise accessible to the control circuitry 101. As such, whether configured by hardware or by a combination of hardware and software, the control circuitry 101 may represent an entity (e.g., physically embodied in circuitry—in the form of control circuitry 101) capable of performing operations according to example embodiments while configured accordingly. Thus, for example, when the control circuitry 101 is embodied as an ASIC, FPGA, or the like, the control circuitry 101 may be specifically configured hardware for conducting the operations described herein. Alternatively, as another example, when the control circuitry 101 is embodied as an executor of software instructions, the instructions may specifically configure the control circuitry 101 to perform the operations described herein.

The communication interface 104 may include one or more interface mechanisms for enabling communication by controlling the radio 110 to generate the communications links 150 and 151. In some cases, the communication interface 104 may be any means such as a device or circuitry embodied in either hardware, or a combination of hardware and software that is configured to receive or transmit data from/to devices in communication with the control circuitry 101. The communications interface 104 may support wireless communications via the radio 110 using various communications protocols (802.11WIFI, Bluetooth, cellular, WLAN, 3GPP NR or the like). Further, the communications interface 104 may be configured to conduct communications under 5G communications protocols including those that leverage centimeter-wave and millimeter-wave communications.

The antenna configuration controller 105 may be a component or module configured to control the configuration of the antenna assembly 115, and more specifically, control the states of the switches of the switch array 117 as described herein. The antenna configuration controller 105 may be configured, according to some example embodiments, to individually control the switches of the switch array 117 via, for example, addressable pins, multiplexing, or the like. According to some example embodiments, the antenna patch array 116 of the antenna assembly 115 may comprise a plurality of antenna patches (e.g., patch elements) connected to each other via electrically controllable switches of the switch array 117. In this regard, as mentioned above and described further below, the antenna configuration controller 105 may be configured to provide signals to control the switches of the switch array 117 to change the state of the switches and thereby the physical dimensions of an operating portion of the antenna patch array 116 to provide for operation of the antenna assembly 115 at different frequencies and wavelengths. The antenna assembly 115 may be driven by the radio 110 which may supply the signals to the antenna assembly 115 for wireless transmission or receive signals from the antenna assembly 115 for decoding and provision to the control circuitry 101.

The radio 110 may be any type of physical radio comprising radio components. For example, the radio 110 may include components such as a power amplifier, mixer, local oscillator, modulator/demodulator, and the like. The components of the radio 110 may be configured to operate in a plurality of spectral bands. In this manner, the components of the radio 110 may be adaptable based on the configuration of the antenna assembly 115. According to some example embodiments, the radio 110 may include amplitude and phase shift control circuitry that supports beam forming, MIMO precoding control circuitry, and ADC/DAC (analog to digital converter/digital to analog converter) that are configurable based on the communications mode and configuration of the antenna assembly 115. As such, according to some example embodiments, dedicated radio circuitry for operation in each of the different antenna communications modes may not be required, and therefore a single radio and associated components may be configured or adjusted and utilized in response to changes in the communications mode of the antenna assembly 115. Further, the radio 110 may be configured to receive signals from the control circuitry 101 for transmission to the antenna assembly 115. In some example embodiments, the radio 110 may be a software defined radio.

The following provides a further description of example embodiments of the antenna assembly 115 and the manners in which the antenna assembly 115 may be controlled (e.g., via operation of the antenna configuration controller 105) to operate as a reconfigurable antenna. The antenna assembly 115 may be constructed and configured based on the principle that the operating frequency of an antenna is inversely proportional to the physical dimension of the antenna. As such, by changing the dimensions of the antenna dynamically, the frequency and wavelength at which the antenna operates can be controlled. For example, centimeter-wave antenna that is split into physically smaller pieces could operate as one or more millimeter-wave antennas. Similarly, if multiple antennas could be joined physically, then the multiple millimeter-wave antennas could be configured to act as a single centimeter-wave antenna.

Figure 2:
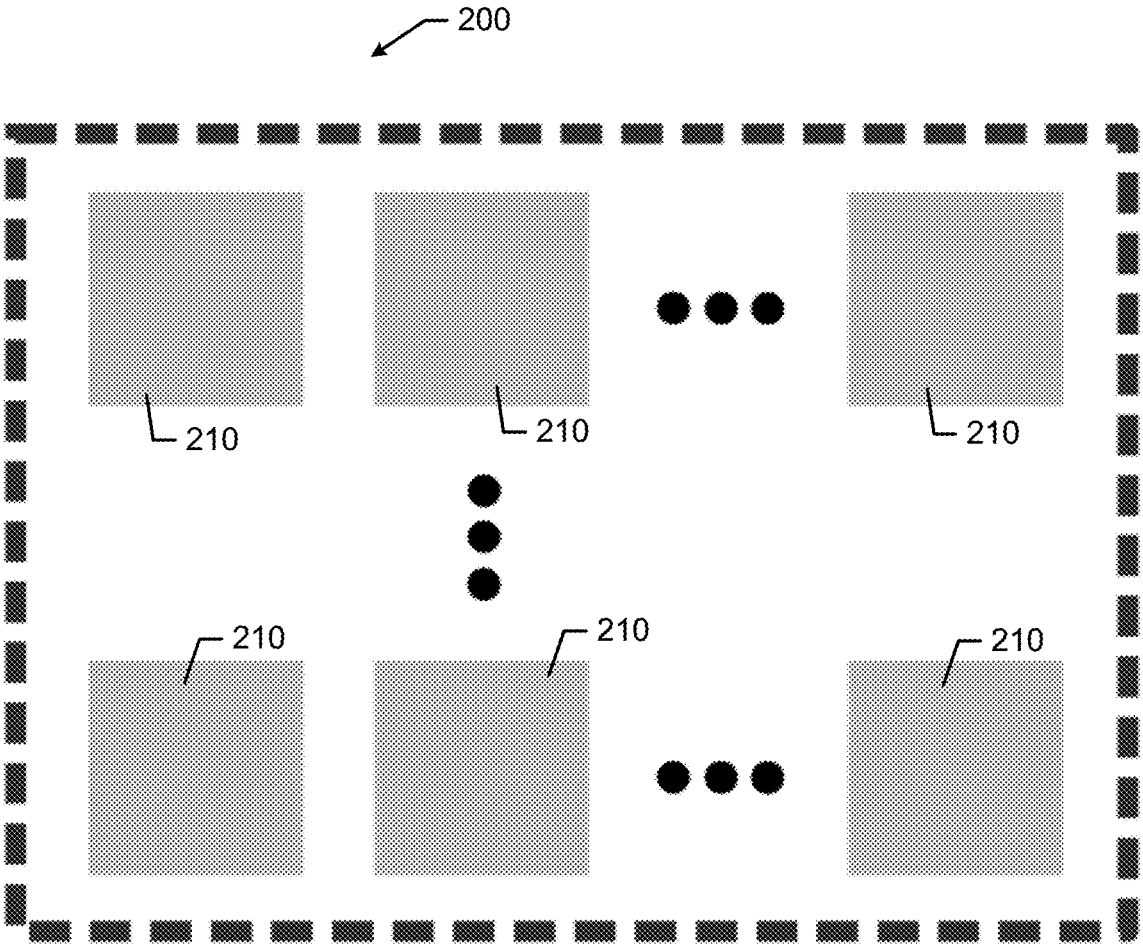
FIG. 2 illustrates an example array of antenna patches according to some example embodiments.

The following describes some configurations of example antenna patch arrays (e.g., antenna patch array 116) that could be components of the antenna assembly 115 according to some example embodiments. Additionally, analysis of the operation of the antenna patch arrays in a given configuration is also described. According to some example embodiments, the antenna assembly 115 may comprise an N by N (or square) phased array 200 of antenna patches 210 as shown in FIG. 2. The antenna patches 210 may be sized to operate at, for example, 28 GHz when operated as a beam forming phased array. The antenna patches 210 may be organized in a grid, and the patches 210 may be, for example, square or rectangular in shape. Each patch 210 may be affixed to a planar substrate and may be formed of a conductor such as metal (e.g., aluminum).

Figure 3:
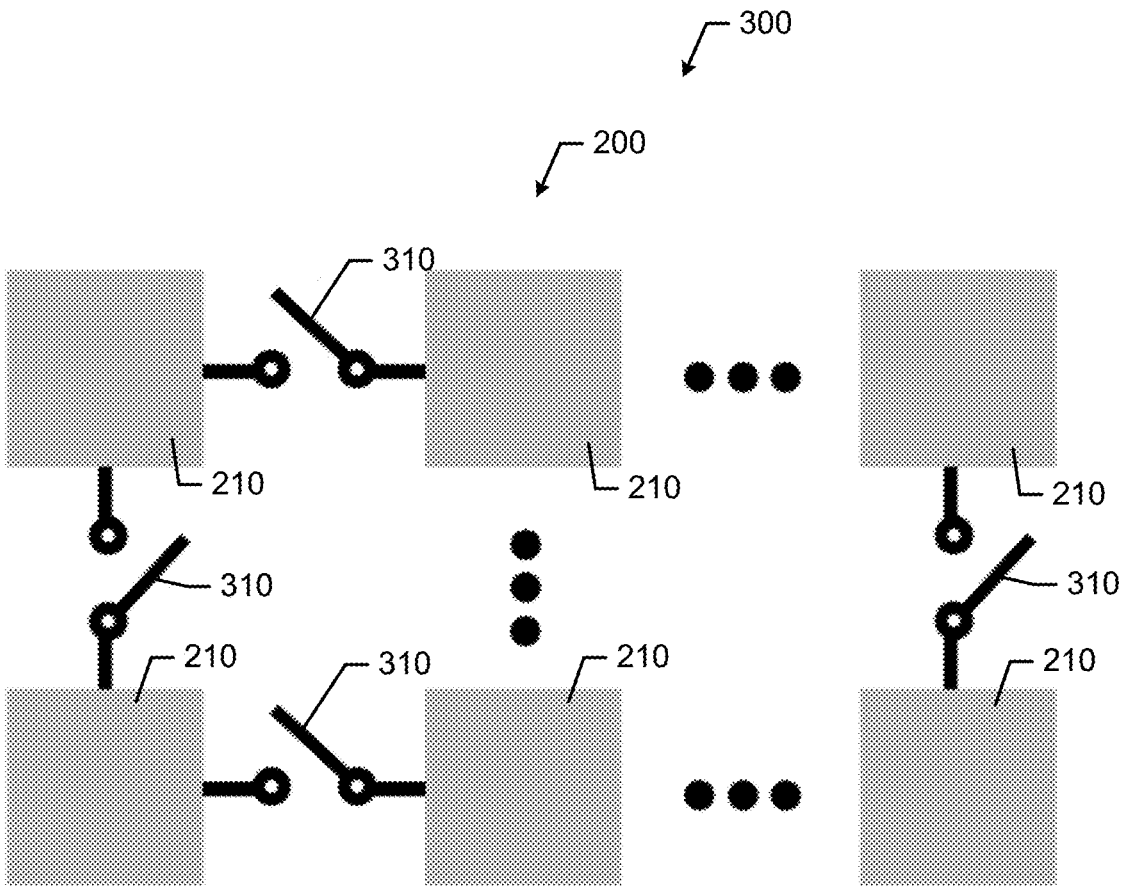
FIG. 3 illustrates an example array of antenna patches with intermediate switches according to some example embodiments.

As shown in FIG. 3, according to some example embodiments, an antenna assembly 300 (e.g., a portion of the antenna assembly 115) may include the antenna patch array 200 comprising antenna patches 210. However, the antenna patches 210 may have switches 310 disposed between each edge of a patch 210 that has an adjacent patch 210 within the grid of patches 210. The edge of the patch 210 may form a portion of the perimeter of the patch 210 at the outer extents of the patch 210. The switches 310 are shown as connected to a mid-edge portion of the edge of the patches 210, since the switches are not connected at or near the corners of the patches 210. The switches 310 may be configured to connect (e.g., in a conducting state) the patches 210 to form a connected, larger antenna or disconnect (e.g., in a non-conducting state) the patches 210 to form one or more smaller antennas. The switches 310 may be controlled by, for example, the antenna configuration controller 105. Although not shown in FIG. 3, each switch 310 may be a three-terminal device with two terminals being on either side of the switch and a third terminal that controls the state of the switch.

Figure 4:
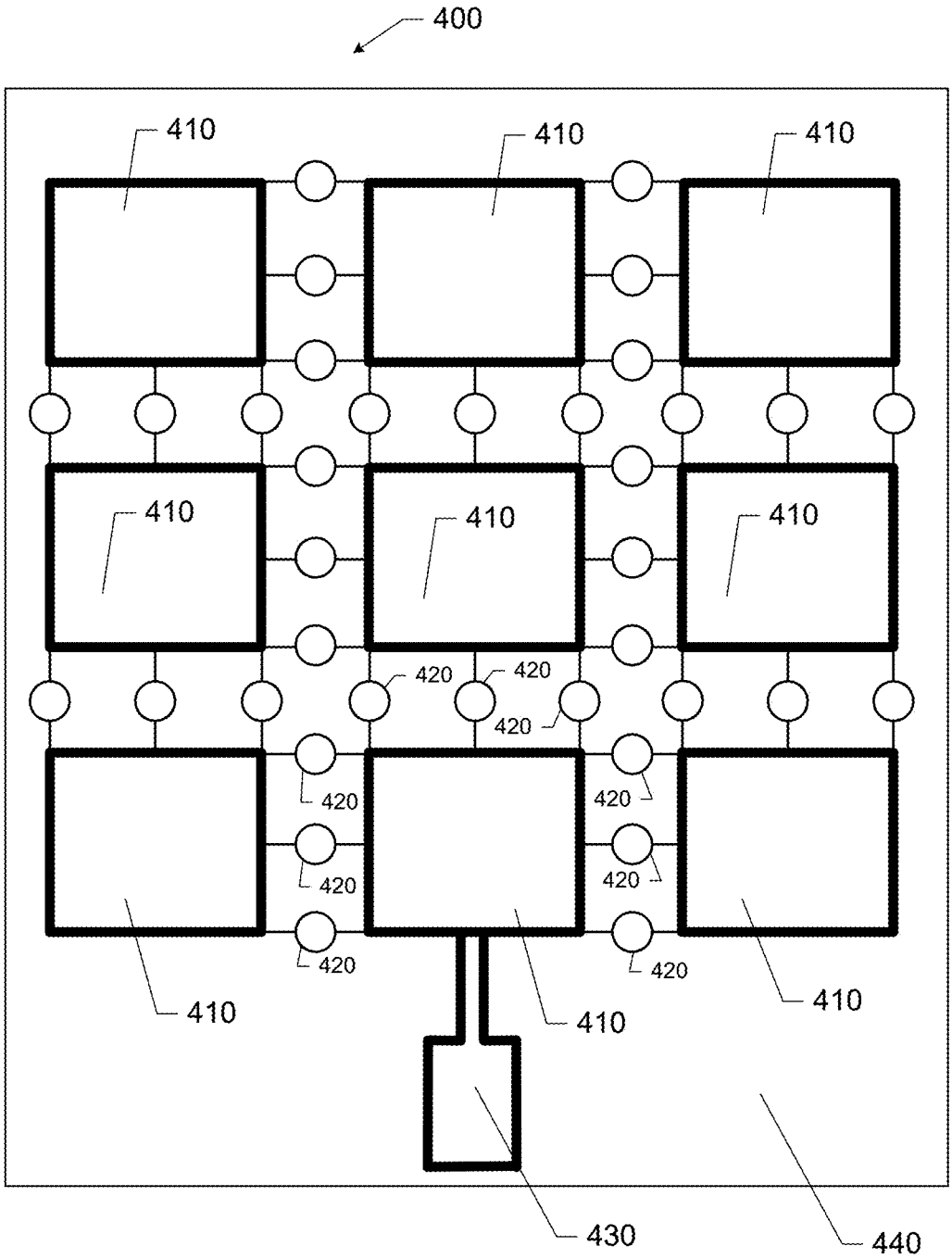
FIG. 4 illustrates an example antenna assembly according to some example embodiments.

With reference to FIG. 4, an antenna assembly 400 is shown. The antenna assembly 400 may be comprised of a 3×3 phased array of antenna patches 410 (which may be the same or similar to the patches 210) on a substrate 440 (e.g., an epoxy glass substrate such as an FR4 substrate). The antenna patches 410 may therefore comprise an patch antenna array. According to some example embodiments, as shown in FIG. 4, the antenna patches 410 may be connected to each adjacent patch 410 at each edge by, for example, three switches 420 (only a few are labeled) indicated by the connected circles between the patches 410. The three switches 420 (which may be the same or similar to the switch 310) may be arranged between two adjacent patches 410 to have a first switch 420 that connects between two edge corners of two patches 410, a second switch that connects between two mid-edge portions of the two patches 410, and a third switch that connects between the other two edge corners of the two patches 410. Such a switch configuration may be implemented between edges of the patches 410 that are adjacent to the an edge of another patch 410. As such, according to some example embodiments, thirty-six switches 420 may be employed between the various patches 410 of the 3×3 patch array. While three switches 420 are used in this example embodiment, it is understood that any number of switches may be disposed between the edges of the adjacent patches 410. The switches 420 may form a switch array of the antenna assembly 400. The phased array of patches 410 may be driven by an input/output port 430, which may be connected to a radio (e.g., radio 110). The input/output port 430 may be electrically connected directly to one of the patches 410 (e.g., the bottom row, centrally located patch 410) and to the other patches 410 via the switches 420. In this regard, a communications signal to be output by the antenna assembly 400 may be provided to the port 430 to be transmitted by the antenna assembly 400, or a communications signal received by the antenna assembly 400 may be provided as an electrical signal at the port 430 to the radio.

Figure 5:
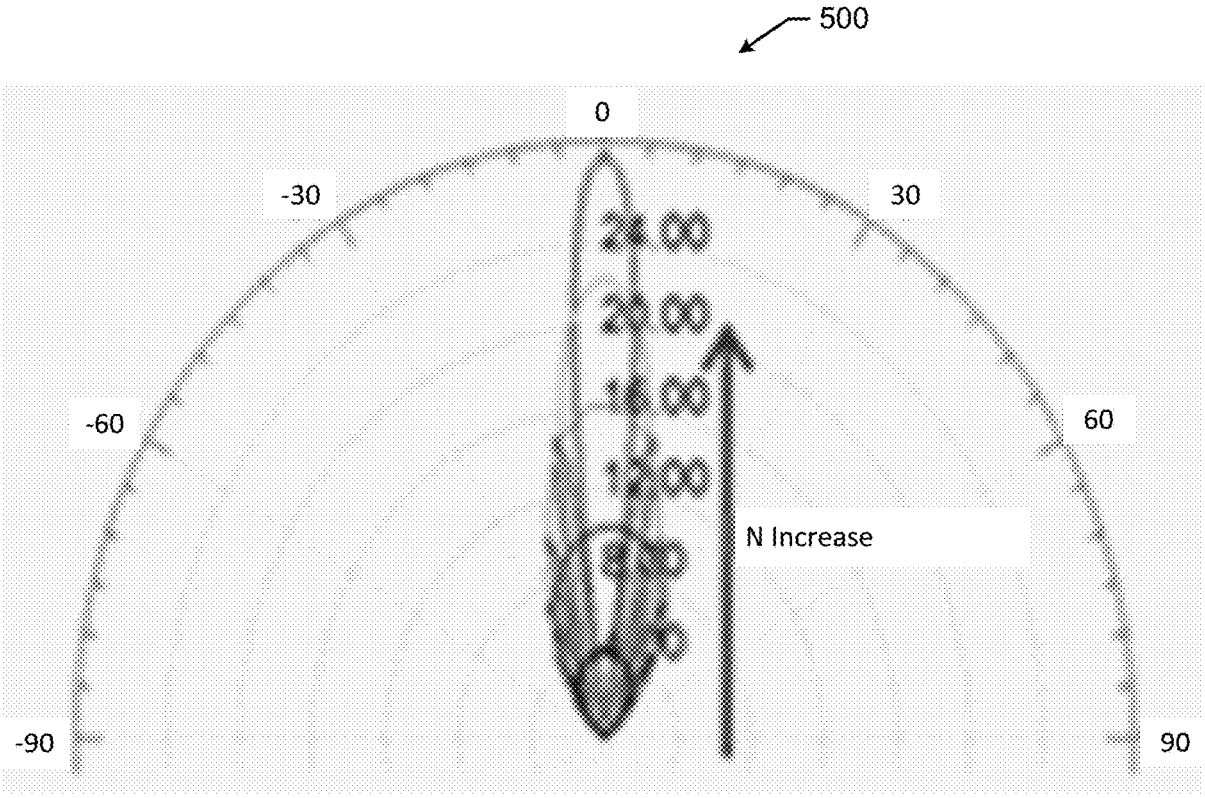
FIGS. 5 and 6 shows graphs of beamwidth control according to some example embodiments.
Figure 6:
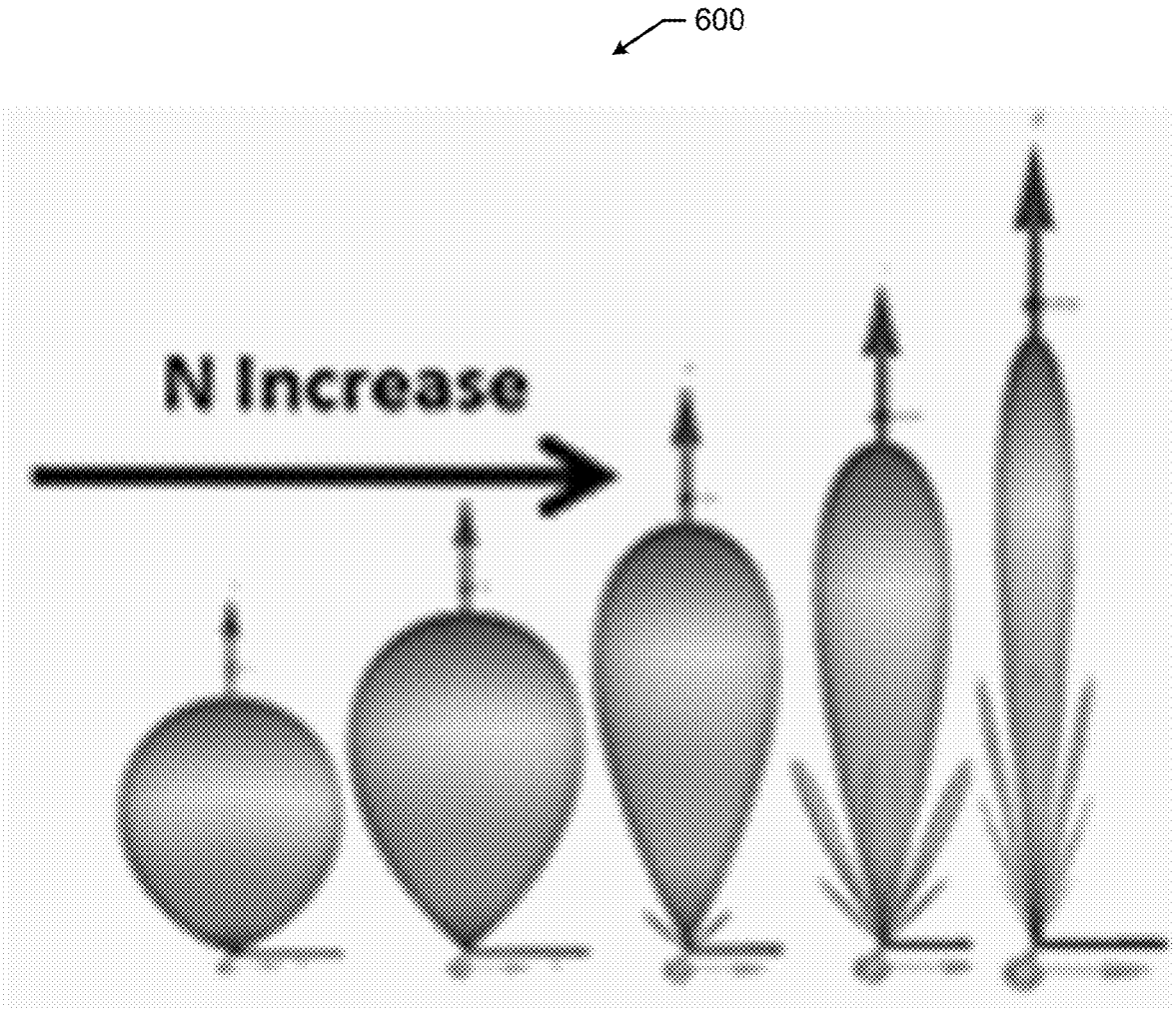

Initially, for example, with the patches 410 operating as a phased array at 28 GHz, beamforming may be performed by controlling the signals to the patches 410 to steer the main beam direction by appropriate amplitude and phase-shift control. In this regard, according to some example embodiments, the radio may be separately connected to each patch 410 in the array to provide a separate signal for beam steering. The graphs 500 and 600 of FIGS. 5 and 6, respectively, show the beamwidth control of a phased array antenna (e.g., a millimeter-wave antenna) as the number of patches 410 in the array increases.

Figure 7:
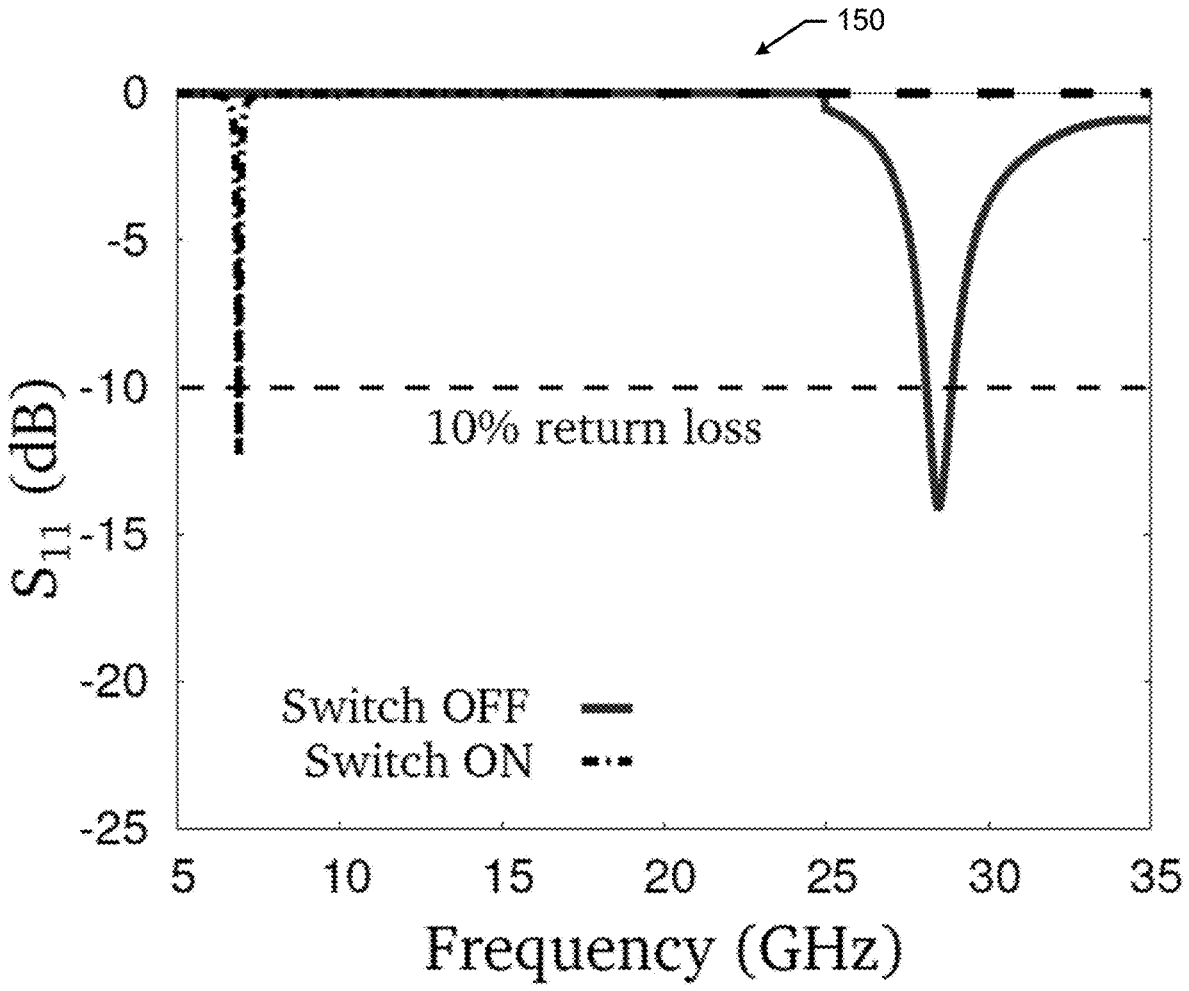
FIG. 7 shows a graph of return losses for different switching configurations according to some example embodiments.

Analyses have been performed to show the performance of an example antenna assembly, according to some example embodiments, with all of the switches closed (i.e., all adjacent patches 410 are shorted together) and also with all of the switches open (i.e., all adjacent patches 410 are disconnected). The graph 700 of FIG. 7 shows that the antenna assembly 400 resonates at, for example, the desired frequencies for millimeter-wave and centimeter-wave. In this regard, the graph 700 shows the frequency reconfigurability between 28.45 GHz to 6.9 GHz through measure of the return losses (Si') with all switches 420 in the conducting/closed/on position/state and the non-conducting/open/off position/state.

The switches 420 may be formed in a number of different ways. High-frequency switching technologies, such as radio frequency microelectromechanical systems (RF MEMS), PIN (p-type intrinsic n-type material) diodes, field effect transistors (FETs), high electron mobility transistors (HEMTs), or the like. In this regard, PIN diodes can, for example, have excellent centimeter-wave performance, but may draw high current in the low-loss state. While FET switches may require very low control power, FET switches may suffer from relatively high insertion losses. RF MEMS switches, albeit with relatively low switch speed, may consume ultra-low power, and may have high switch performance with a high linear response. The fabrication of RF MEMS switches may also be relatively less expensive due to being developed in commercial foundries in the standard back-end-of-line process, enabling monolithic integration. According to some example embodiments, a MEMS switch may provide less than 10 microsecond switch time. As such, the use of RF MEMS switches may be preferred, according to some example embodiments, for the antenna assembly 115 of an example reconfigurable antenna.

Figure 8A:
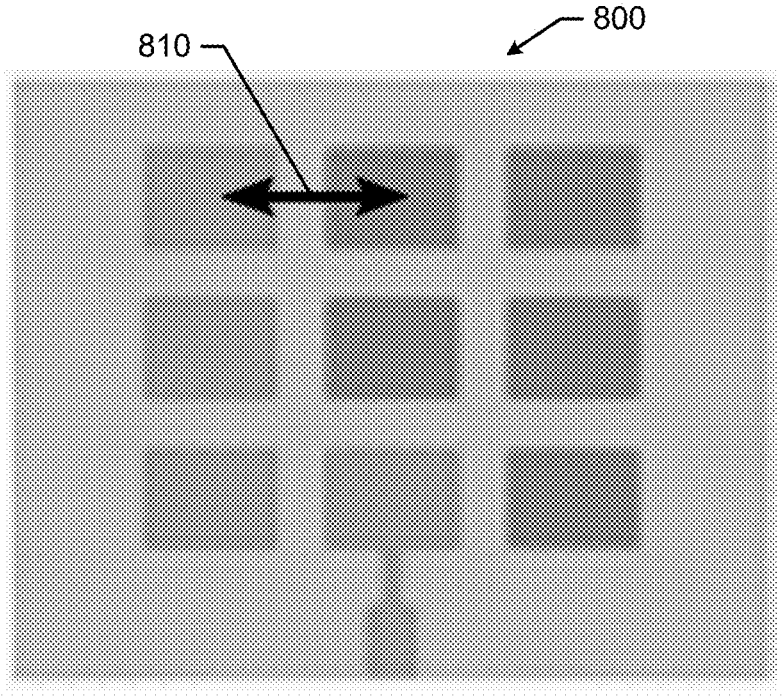
FIG. 8A illustrates an array of antenna patches according to some example embodiments.
Figure 8B:
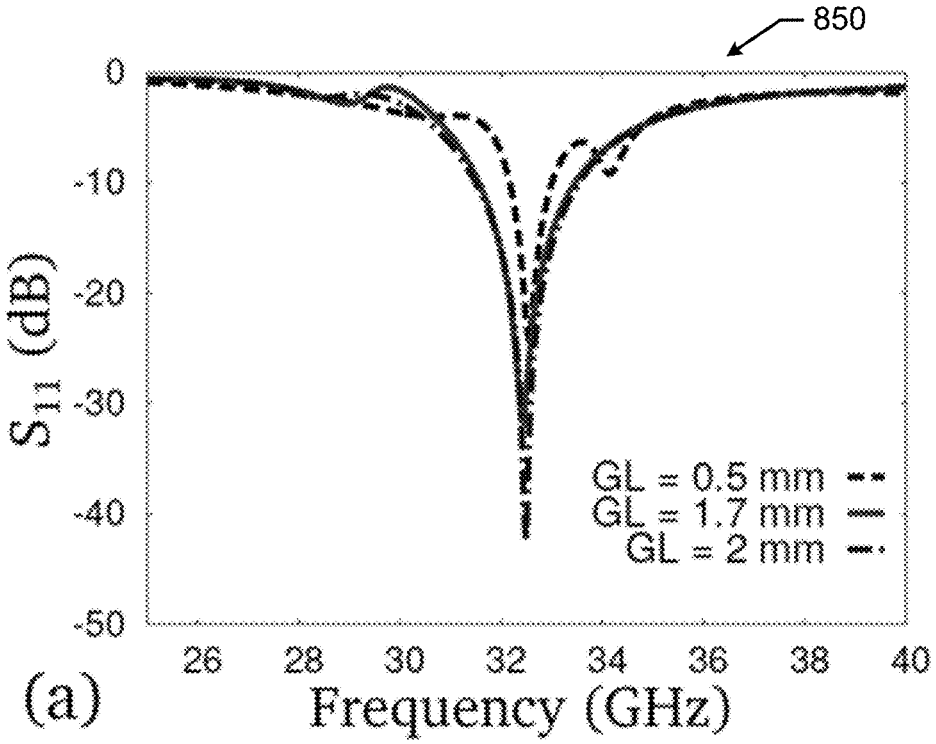
FIG. 8B shows a graph of return losses of the array of antenna patches of FIG. 8A at different gap widths according to some example embodiments.
Figure 9A:
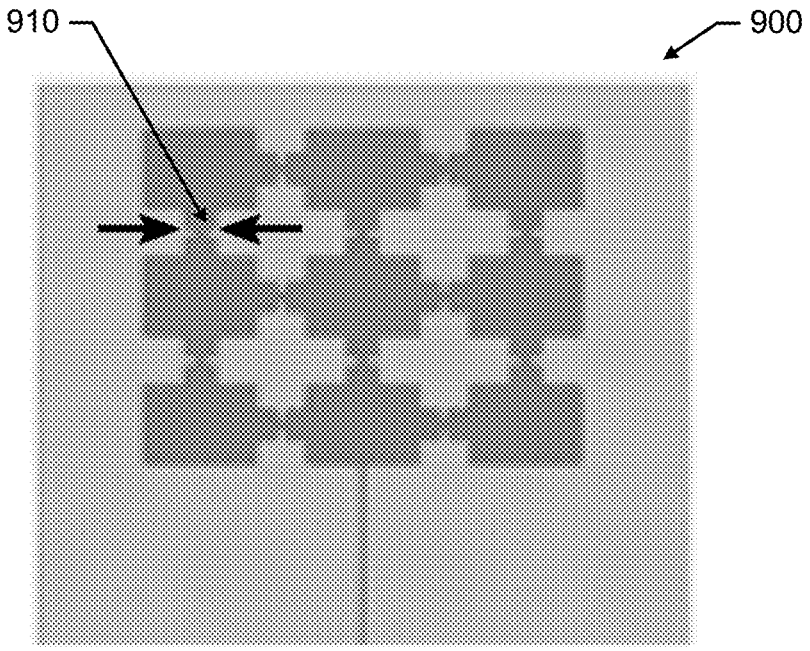
FIG. 9A illustrates an array of antenna patches with switches according to some example embodiments.
Figure 9B:
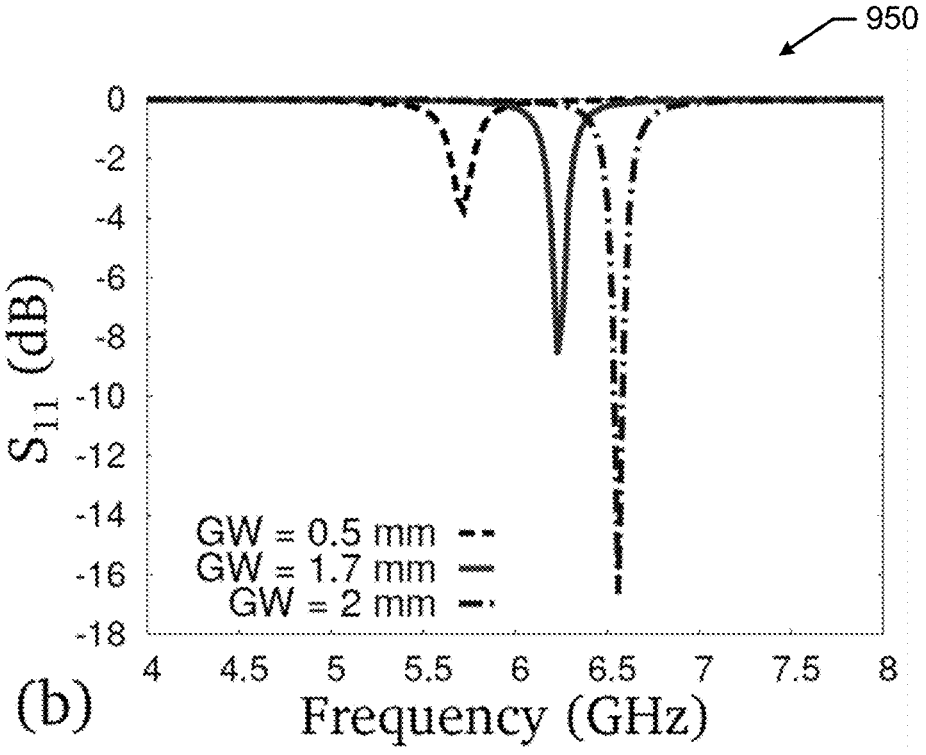
FIG. 9B shows a graph of return losses of the array of antenna patches of FIG. 9A at different switch widths according to some example embodiments.
Figure 10A:
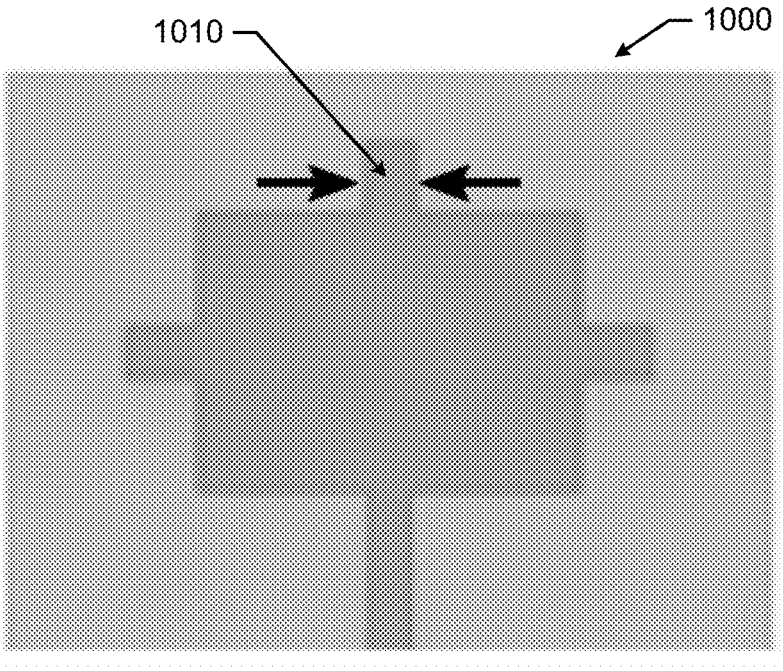
FIG. 10A illustrates an isolated antenna patch with switches according to some example embodiments.
Figure 10B:
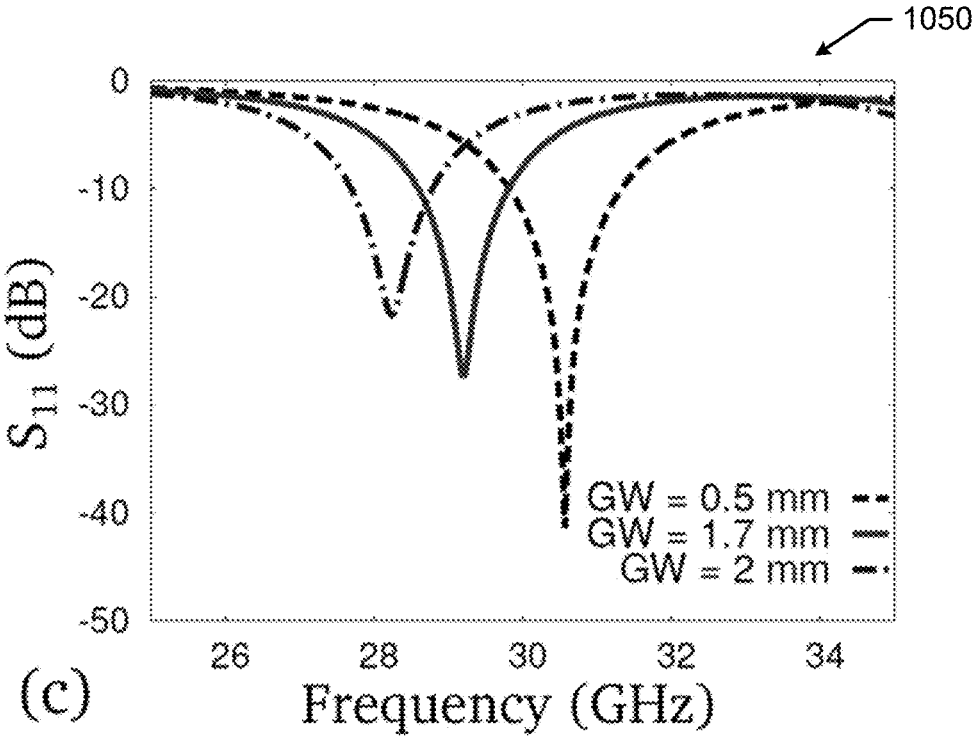
FIG. 10B shows a graph of return losses of the antenna patch of FIG. 10A at different switch widths according to some example embodiments.

An RF MEMS switch may be a micromechanical system with electronically controlled components that are sub-millimeter in size and may be electrostatically actuated. According to some example embodiments, an RF MEMS switch need not consume power to maintain a current state (e.g., conducting or non-conducting). According to some example embodiments, the RF MEMS switch may be a capacitive, fixed beam RF MEMS switch. The use of RF MEMS switches, according to some example embodiments, even with perfect isolation, may increase the physical dimension of individual antenna patches 410, which may adversely affect the millimeter-wave operation. In this regard, FIG. 8A shows an antenna array 800 with a gap length 810 (GL) between the patches defined. As shown in the corresponding graph 850 of FIG. 8B, smaller gap lengths yield poorer response because of the electromagnetic coupling between the patches. In consideration of switch widths 910 with switches in place between the patches of the array 900, the effect of the different switch widths (GW) is shown in graph 950 of FIG. 9B. Similarly, FIG. 10A shows an isolated single patch 1000 with switch width 1010 and the impact of different switch widths (GW) is shown in the graph 1050 of FIG. 10B.

Figure 11A:
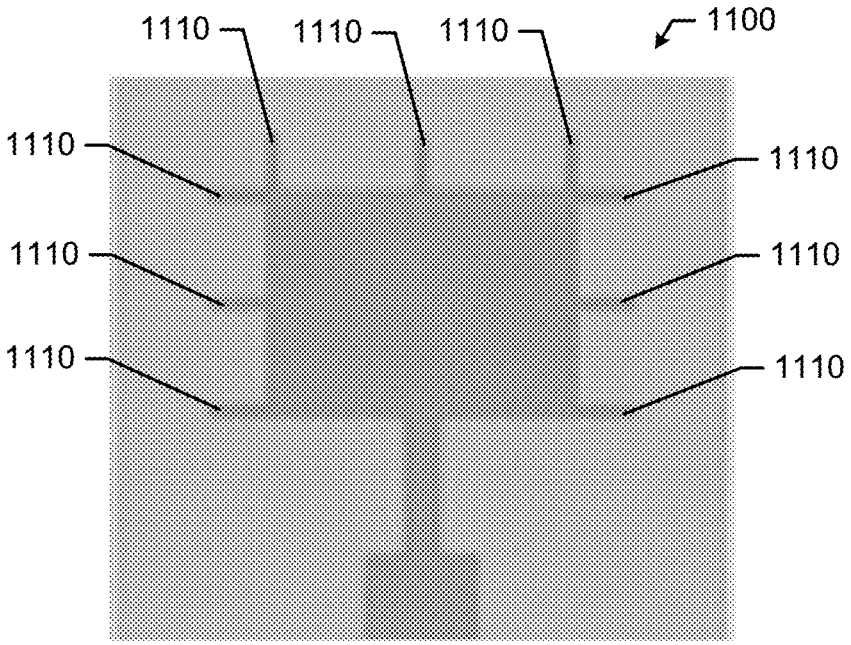
FIG. 11A illustrates an isolated antenna patch with switches according to some example embodiments.
Figure 11B:
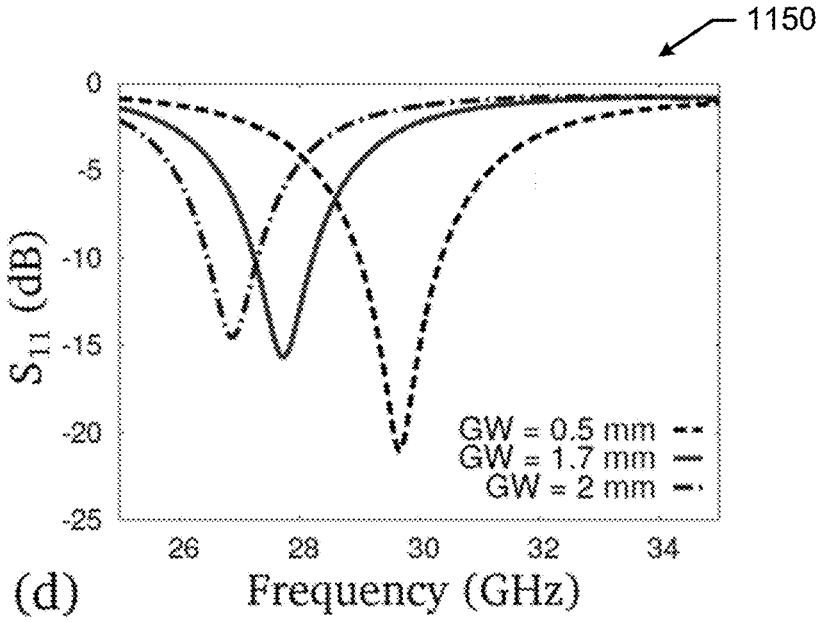
FIG. 11B shows a graph of return losses of the antenna patch of FIG. 11A at different switch widths according to some example embodiments.
Figure 12A:
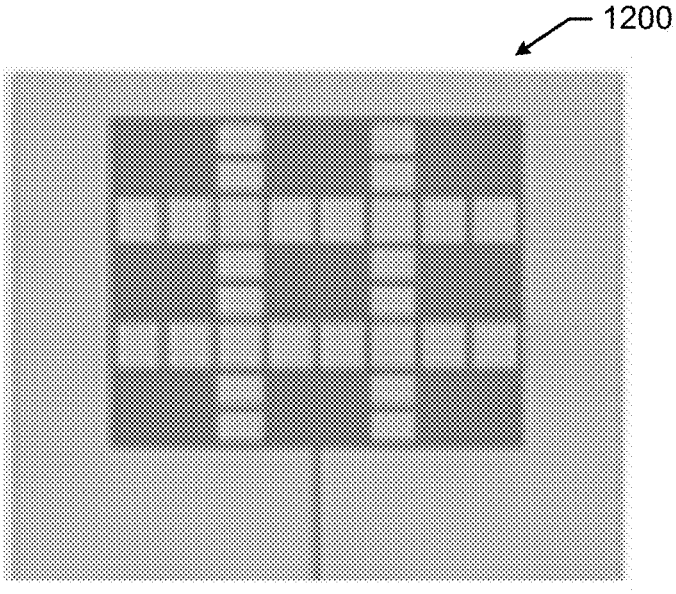
FIG. 12A illustrates an array of antenna patches with switches closed according to some example embodiments.
Figure 12B:
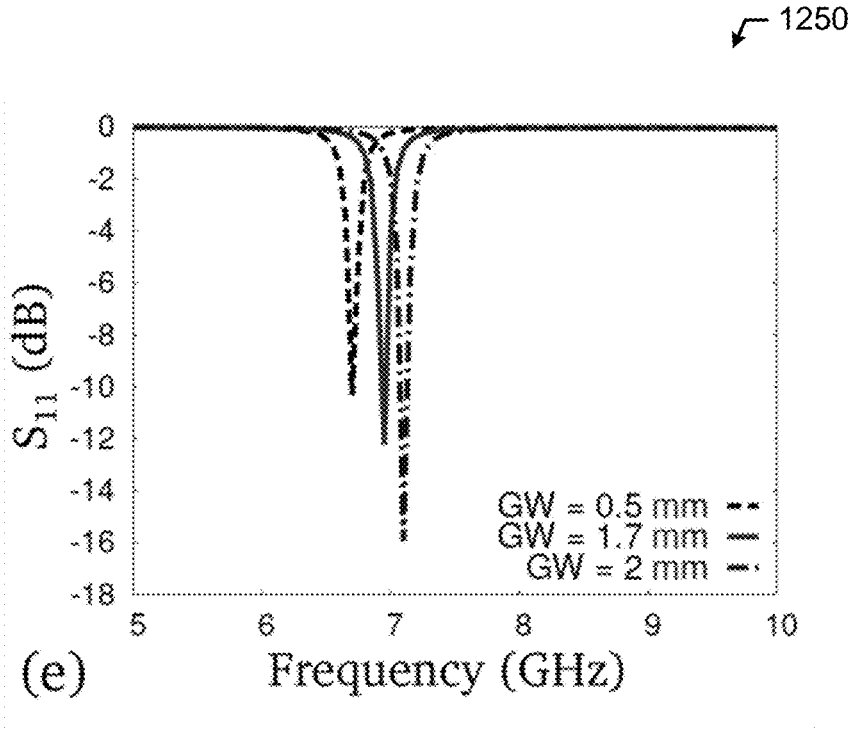
FIG. 12B shows a graph of return losses of the array of antenna patches of FIG. 12A at different switch widths according to some example embodiments.
Figure 13A:
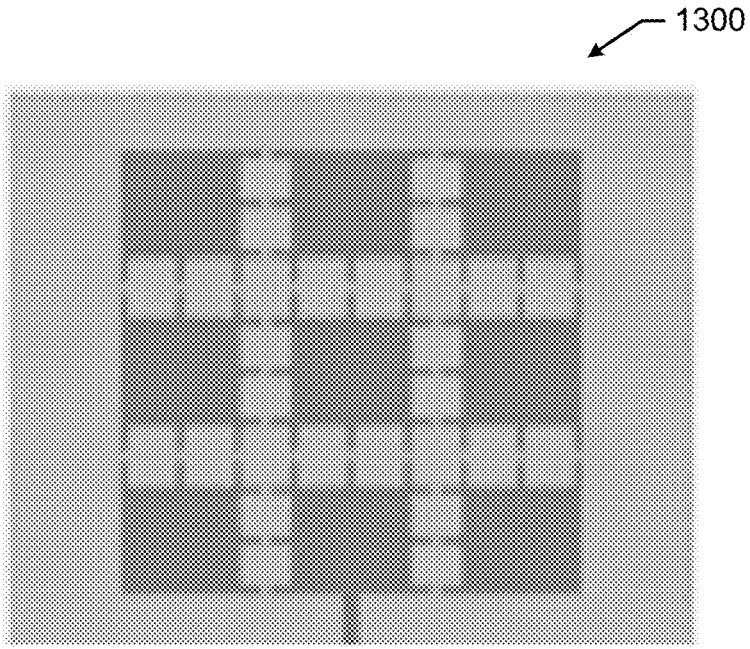
FIG. 13A illustrates an array of antenna patches with switches open according to some example embodiments.
Figure 13B:
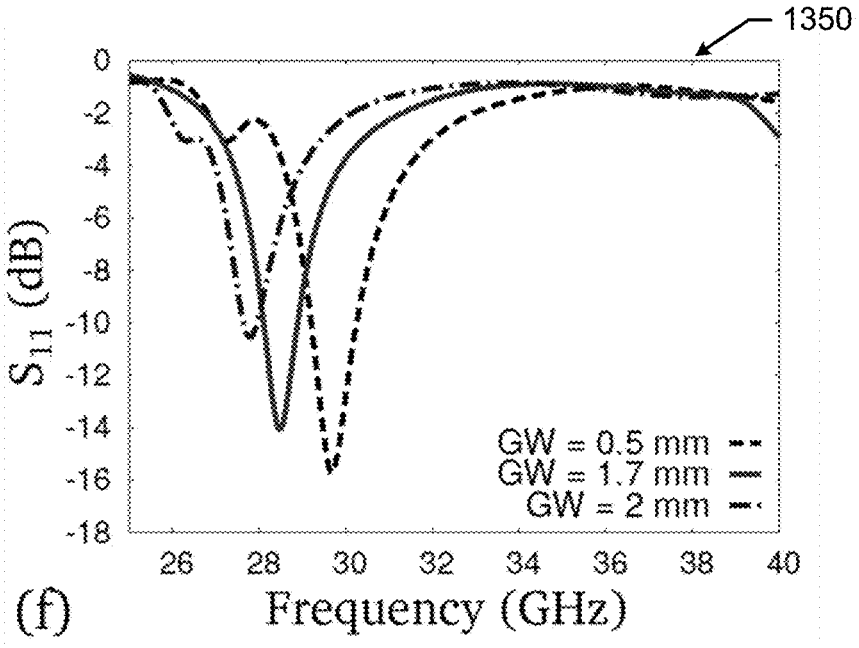
FIG. 13B shows a graph of return losses of the array of antenna patches of FIG. 13A at different switch widths according to some example embodiments.

As such, according to some example embodiments, a larger switch width may change the millimeter-wave frequency response since the area of the antenna increases. However, a larger switch width can yield better performance at centimeter-wave (switches closed) since there are more substantial contacts. To minimize the effect of switch width and achieve effective performance, for example, at both millimeter-wave and centimeter-wave, multiple (e.g., three per edge) narrow switches may be used. In this regard, the isolated patch 1100 of FIG. 11A shows an implementation of multiple narrow switches 1110 (i.e. three switches on each edge adjacent another patch). The graph 1150 of FIG. 11B shows the improved return losses at the different switch widths (GW). In this regard, an array of patches 1200 with closed switches is shown FIG. 12A, and a graph of the response at different switch widths (GW) is shown in graph 1250 of FIG. 12B. Similarly, an array of patches 1300 with open switches is shown FIG. 13A, and a graph of the response at different switch widths (GW) is shown in graph 1350 of FIG. 13B. As such, these graphs 1250 and 1350 show that the antenna achieves improved return losses at, for example, both centimeter-wave and millimeter-wave with multiple narrow switches.

Figure 14A:
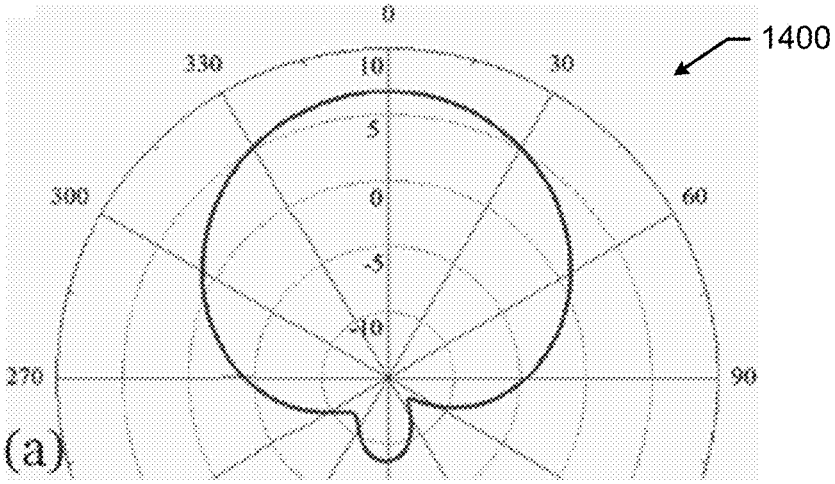
FIGS. 14A and 14B show graphs of beamforming with perfect switch isolation according to some example embodiments.
Figure 14B:
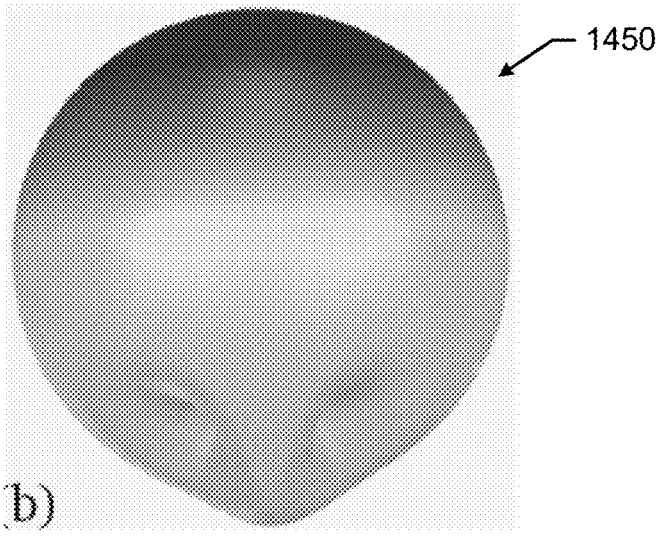
Figure 15A:
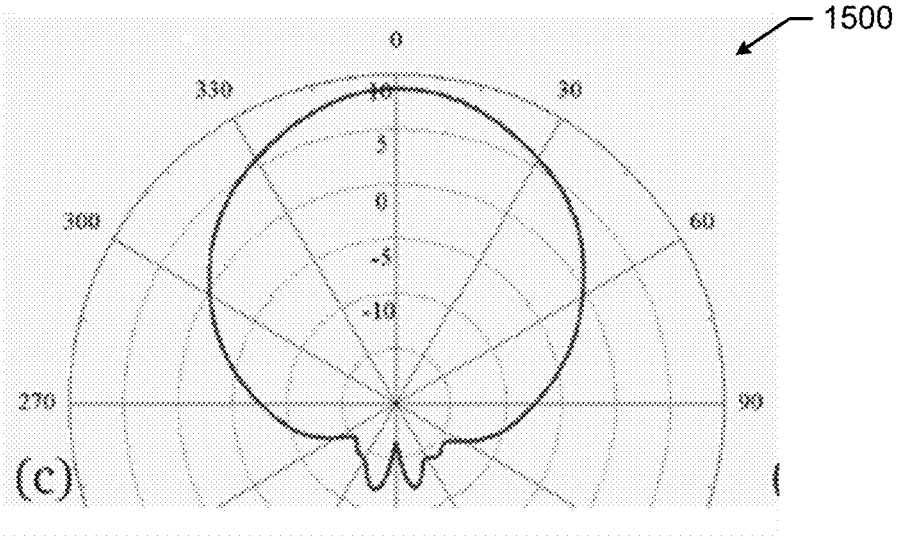
FIGS. 15A and 15B show graphs of beamforming with imperfect switch isolation according to some example embodiments.
Figure 15B:
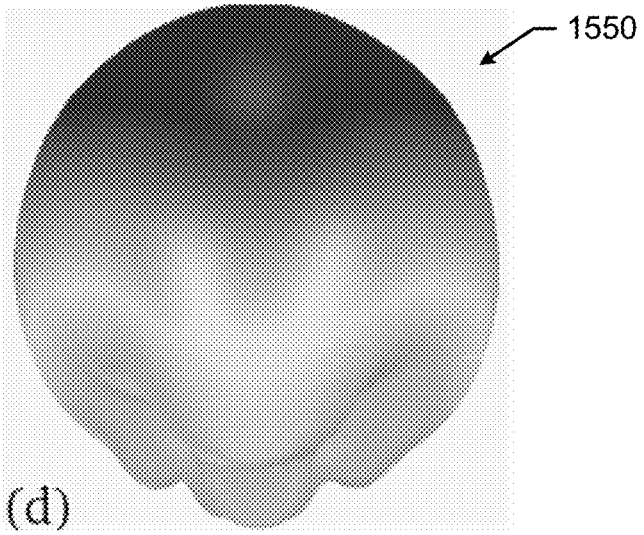

Additionally, because practical switches are not perfect isolators when open, a residual electromagnetic coupling can occur, even when the switches are not conducting or open (turned off), which may affect, for example, millimeter-wave beamforming performance. To understand the effect, the beam patterns may be measured with and without perfect isolation. In this regard, for example, a 60 dB isolation between the patches may be used to emulate beam patterns with approximately perfect switch isolation as shown in the graphs 1400 and 1450 in FIGS. 14A and 14B, respectively. However, 30 dB isolation between patches may be used for the imperfect case. As such, graphs 1500 and 1550 in FIGS. 15A and 15B, respectively, show the beam patterns for the imperfect case. As can be seen, gain variations between the perfect and imperfect cases are present on the beam pattern, but the differences are not significant. However, according to some example embodiments, a larger phased-array may suffer more from the imperfect isolation. Such imperfection may be overcome by appropriate codebook design for millimeter-wave phased array.

Compared to a traditional architecture with isolated centimeter-wave and millimeter-wave antennas, the underlying circuits and signal processing modules of a radio for the reconfigurable antenna, according to some example embodiments, may remain unchanged. In other words, according to some example embodiments, the reconfigurable antenna may operate in association with a circuitry that can support operation in more than one communications mode, without requiring dedicated circuitry for each mode. Rather, the circuitry may also be reconfigured for operation in the current communications mode (e.g., centimeter-wave mode or millimeter-wave mode) of the reconfigurable antenna.

For example, the amplitude and phase-shift circuit of, for example, the radio 110, may control the analog beamforming, and the digital MIMO (multiple-input and multiple-output) precoding module of, for example, the radio 110, may control the digital beamforming. Additionally, according to some example embodiments, the switch trigger logic of the antenna configuration controller 105 may multiplex the operations between millimeter-wave and centimeter wave modes. However, the reconfigurable antenna, according to some example embodiments, may support reuse of at least some of the signal processing modules (e.g., within and implemented by the control circuitry 101). For example, the MIMO precoder of the radio 110 may be reused for millimeter-wave hybrid beamforming to serve multiple users. Additionally, the amplitude and phase-shift circuit, of the radio 110, may be reused for centimeter-wave mode operation to reduce the precoding complexity. Also, the ADC/DAC chain, of the radio 110, can be reconfigured dynamically to adapt to MHz and GHz sampling for centimeter-wave and millimeter-wave modes, respectively. Thus, instead of duplicating the circuits and signal processing modules, a reconfigurable antenna, according to some example embodiments, may allow for integration of the circuits and processing modules for operation in either mode to reduce the cost and size, improve battery life, achieve better performance, and increase manufacturability.

Figure 16:
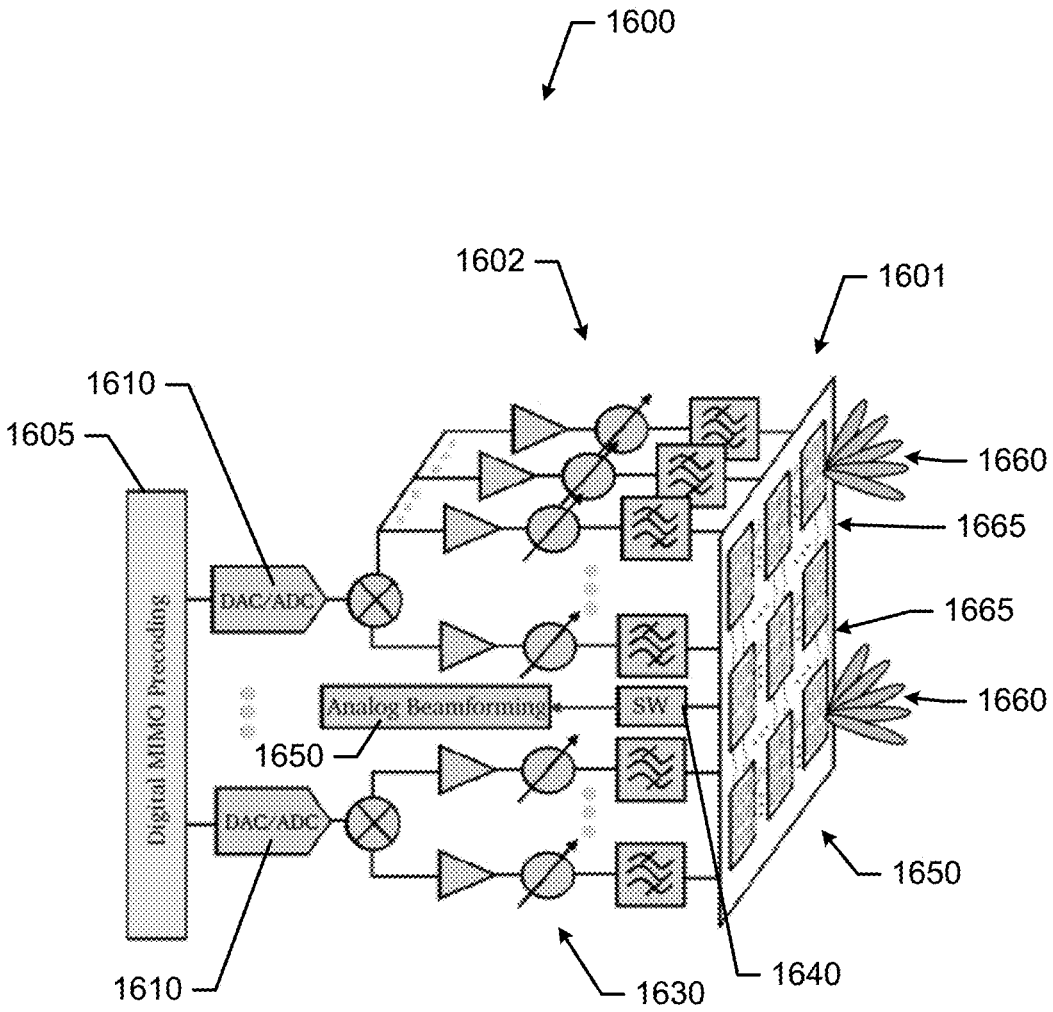
FIG. 16 illustrates an example reconfigurable antenna according to some example embodiments.

FIG. 16 shows an example implementation of a reconfigurable antenna 1600 in a block-diagram, schematic form. The reconfigurable antenna 1600 may comprise components of a radio 1602 comprising analog amplitude and phase-shift control 1630, DAC/ADC chain 1610, and digital MIMO precoding module 1605, each of which may be components of control circuitry 101 or the radio 110 of FIG. 1. The switching logic 1640 may an example of the antenna configuration controller 105. Individual antenna patches (which may be individually sized for millimeter wave operation) in the antenna patch array 1650 may use amplitude and phase-shift control 1630 to steer an analog beam at 1660. Triggered on the switching logic to place switches 1665 disposed between the patches in a conducting or short-circuit state thereby electrically connecting some or all of the antenna patches, may form one or more larger dimension antennas so that the frequency and wavelength of the reconfigurable antenna 1600 may be tuned to, for example, centimeter-wave mode or millimeter-wave mode. The reconfigurable antenna 1600 may achieve MIMO functionality at centimeter-wave through the digital precoding module 1605.

Having described the structure and operation of example embodiments of the reconfigurable antenna provided herein, it is noted that many recent efforts in 5G have been addressing coordination issues between centimeter-wave and millimeter-wave connections and antennas. Software approaches may use centimeter-wave communication channel as a backup, redundant, or split path for millimeter-wave communication channel. As mentioned above, millimeter-wave connections can offer multiple gigabits per second wireless speed, but are susceptible to blockage, for example, in the context of mobility. Centimeter-wave connections may be relatively slow, but offer reliable connectivity. Thus, a combination of the two channels may be used for next-generation wireless and cellular standards and devices for both fast and reliable connectivity. The approach, according to some example embodiments, does not rely on separate hardware (including separate antennas) for the combined operations, and thus, has addressed a fundamental challenge of limited physical space on mobile devices. As such, the reconfigurable antenna, according to some example embodiments, can operate to achieve practical spectrum flexibility on limited physical space mobile devices.

Accordingly, an example embodiment of a reconfigurable antenna in the form of an apparatus (e.g., communications device 100) will now be described. In this regard, the apparatus may comprise an antenna assembly (e.g., antenna assembly 115), and the antenna assembly may comprise an antenna patch array (e.g., antenna patch array 116) comprising a plurality of antenna patches (e.g., patches 410). The apparatus may further comprise a switch array (e.g., switch array 117) comprising plurality of switches (e.g., switches 420). In this regard, each switch of the plurality switches may be electronically controllable to transition between states comprising a conducting state and a non-conducting state. Further, each switch may be electrically connected between two of the antenna patches of the antenna array. The apparatus may further comprise control circuitry (e.g., control circuitry 101) that is configured to control the states of the switches of the switch array to operate the antenna patch array in a first communications mode at a first wavelength, and control the states of the switches of the switch array to operate the antenna patch array in a second communications mode at a second wavelength.

According to some example embodiments, the antenna patches of the antenna patch array may be individually sized for millimeter-wave operation. Additionally, the first wavelength may be a millimeter-wave wavelength, and the second wavelength is a centimeter-wave wavelength. Additionally or alternatively, the antenna patch array may comprise a first antenna patch and a second antenna patch, and the switch array may comprise a first switch connected between the first antenna patch and the second antenna patch. The first switch may be controlled by the control circuitry to be in a non-conducting state in the first communications mode, and the first switch may be controlled by the control circuitry to be in a conducting state in the second communications mode. Additionally, according to some example embodiments, the switch array may further comprise a second switch and a third switch. The second switch may be connected between the first antenna patch and the second antenna patch. The third switch may be connected between the first antenna patch and the second antenna patch. According to some example embodiments, the second switch and the third switch may be controlled by the control circuitry to be in a non-conducting state in the first communications mode, and the second switch and the third switch may be controlled by the control circuitry to be in a conducting state in the second communications mode. Additionally, the antenna patch array may further comprise a third antenna patch, and the switch array may further comprise a fourth switch, a fifth switch, and a sixth switch. Each of the fourth switch, the fifth switch, and the sixth switch may be connected between the first antenna patch and the third antenna patch. The fourth switch, the fifth switch, and the sixth switch may be controlled by the control circuitry to be in a non-conducting state in the first communications mode, and the fourth switch, the fifth switch, and the sixth switch may be controlled by the control circuitry to be in a conducting state in the second communications mode.

Additionally or alternatively, according to some example embodiments the switches of the switch array may comprise radio frequency microelectromechanical systems (RF MEMS) switches, p-type intrinsic n-type (PIN) diodes, or field effect transistors (FETs). Additionally or alternatively, according to some example embodiments, each antenna patch of the antenna patch array may be connectable to two other antenna patches via the switch array.

Additionally or alternatively, according to some example embodiments, each antenna patch may comprise a rectangular shape and the antenna patch array may be arranged in a grid. The antenna patch array may comprise a first antenna patch and a second antenna patch. The switch array comprises a first switch, a second switch, and a third switch connected between the first antenna patch and the second antenna patch. The first switch may be connected between a first edge corner of the first antenna patch and a first edge corner of the second antenna patch. The second switch may be connected between a second edge corner of the first antenna patch and a second edge corner of the second antenna patch, and the third switch may be connected between a first mid-edge portion of the first antenna patch and a first mid-edge portion of the second antenna patch. According to some example embodiments, Additionally or alternatively, the antenna patch array may be an N by N array. Additionally or alternatively, the control circuitry may be further configured to perform analog and digital beamforming via the antenna patch array in both the first communications mode and the second communications mode. Additionally or alternatively, the control circuitry may comprise a digital to analog converter/analog to digital converter (DAC/ADC) that operates in both the first communications mode and the second communications mode.

Figure 17:
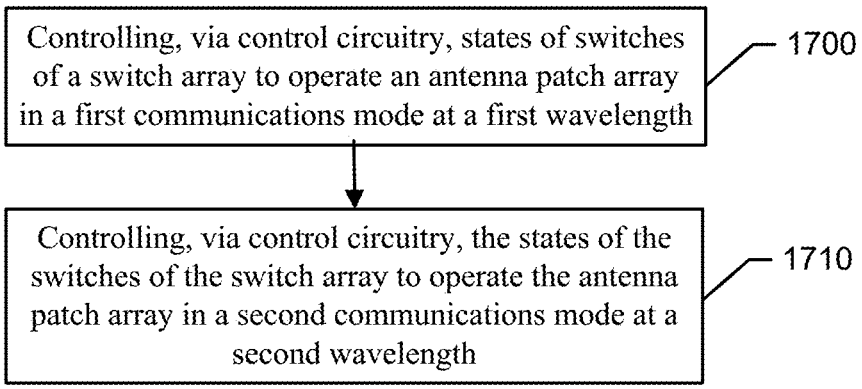
FIG. 17 illustrates a flow chart of an example method of configuring a reconfigurable antenna according to some example embodiments.

Referring now to FIG. 17, a flowchart of an example method for configuring and controlling a reconfigurable antenna is provided. The example method may include, at 1700, controlling, via control circuitry, states of switches of a switch array to operate an antenna patch array in a first communications mode at a first wavelength. In this regard, the antenna patch array may comprise a plurality of antenna patches and the switch array may comprise a plurality of switches. Each switch of the plurality switches may be electronically controllable by the control circuitry to transition between states comprising a conducting state and a non-conducting state. Each switch may be electrically connected between two of the antenna patches of the antenna array. According to some example embodiments, the example method may further comprise, at 1710, controlling, via control circuitry, the states of the switches of the switch array to operate the antenna patch array in a second communications mode at a second wavelength.

Additionally, according to some example embodiments, the antenna patches of the antenna patch array may be individually sized for millimeter-wave operation. Further, the first wavelength may be a millimeter-wave wavelength, and the second wavelength may be a centimeter-wave wavelength. Additionally or alternatively, the antenna patch array may comprise a first antenna patch and a second antenna patch. The switch array may comprise a first switch connected between the first antenna patch and the second antenna patch. In this regard, the example method may further comprise controlling, by the control circuitry, the first switch to be in a non-conducting state in the first communications mode, and controlling, by the control circuitry, the first switch to be in a conducting state in the second communications mode.

Additionally, according to some example embodiments, the switch array may further comprise a second switch and a third switch. The second switch may be connected between the first antenna patch and the second antenna patch, and the third switch may be connected between the first antenna patch and the second antenna patch. Additionally or alternatively, the example method may comprise controlling, by the control circuitry, the second switch and the third switch to be in a non-conducting state in the first communications mode, and controlling, by the control circuitry, the second switch and the third switch to be in a conducting state in the second communications mode. Additionally or alternatively, the antenna patch array may further comprise a third antenna patch, and the switch array may further comprise a fourth switch, a fifth switch, and a sixth switch. Each of the fourth switch, the fifth switch, and the sixth switch may be connected between the first antenna patch and the third antenna patch. According to some example embodiments, the example method may further comprise controlling, by the control circuitry, the fourth switch, the fifth switch, and the sixth switch to be in a non-conducting state in the first communications mode, and controlling, by the control circuitry, the fourth switch, the fifth switch, and the sixth switch to be in a conducting state in the second communications mode. Additionally or alternatively, the switches of the switch array may comprise radio frequency microelectromechanical systems (RF MEMS) switches, p-type intrinsic n-type (PIN) diodes, or field effect transistors (FETs). Additionally or alternatively, according to some example embodiments, each antenna patch of the antenna patch array is connectable to two other antenna patches via the switch array.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements or functions, it should be appreciated that different combinations of elements or functions may be provided by alternative embodiments without departing from the scope of the appended claims. In this regard, for example, different combinations of elements or functions than those explicitly described above are also contemplated as may be set forth in some of the appended claims. In cases where advantages, benefits or solutions to problems are described herein, it should be appreciated that such advantages, benefits or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An apparatus comprising:

an antenna assembly comprising:

an antenna patch array comprising a plurality of antenna patches;

a switch array comprising plurality of switches, each switch of the plurality switches being electronically controllable to transition between states comprising a conducting state and a non-conducting state, and each switch being electrically connected between two of the antenna patches of the antenna array; and a control circuitry comprising an antenna configuration controller individually configured to: control the states of the switches of the switch array to operate the antenna patch array in a first communications mode at a first wavelength; and control the states of the switches of the switch array to operate the antenna patch array in a second communications mode at a second wavelength.

2. The apparatus of claim 1, wherein the antenna patches of the antenna patch array are individually sized for millimeter-wave operation;

wherein the first wavelength is a millimeter-wave wavelength; and wherein the second wavelength is a centimeter-wave wavelength.

3. The apparatus of claim 1, wherein the antenna patch array comprises a first antenna patch and a second antenna patch;

wherein the switch array comprises a first switch connected between the first antenna patch and the second antenna patch via a first two terminals of the first antenna patch and the second antenna patch;

wherein the first switch is, as controlled by the control circuitry, in a non-conducting state in the first communications mode; and wherein the first switch is, as controlled by the control circuitry, in a conducting state in the second communications mode.

4. The apparatus of claim 3, wherein the switch array further comprises a second switch and a third switch;

wherein the second switch is connected between the first antenna patch and the second antenna patch via a second two terminals of the first antenna patch and the second antenna patch; and wherein the third switch is connected between the first antenna patch and the second antenna patch via a third two terminals of the first antenna patch and the second antenna patch.

5. The apparatus of claim 4, wherein the second switch and the third switch are, as controlled by the control circuitry, in a non-conducting state in the first communications mode; and wherein the second switch and the third switch are, as controlled by the control circuitry, in a conducting state in the second communications mode.

6. The apparatus of claim 5, wherein the antenna patch array further comprises a third antenna patch;

wherein the switch array further comprises a fourth switch, a fifth switch, and a sixth switch, each of the fourth switch, the fifth switch, and the sixth switch being connected between the first antenna patch and the third antenna patch via a different two terminals of the first antenna patch and the third antenna patch;

wherein the fourth switch, the fifth switch, and the sixth switch are, as controlled by the control circuitry, in a non-conducting state in the first communications mode; and wherein the fourth switch, the fifth switch, and the sixth switch are, as controlled by the control circuitry, in a conducting state in the second communications mode.

7. The apparatus of claim 1, wherein the switches of the switch array comprise radio frequency microelectromechanical systems (RF MEMS) switches, p-type intrinsic n-type (PIN) diodes, or field effect transistors (FETs).

8. The apparatus of claim 1, wherein each antenna patch of the antenna patch array is connectable to two other antenna patches via the switch array.

9. The apparatus of claim 1, wherein each antenna patch comprises a rectangular shape and the antenna patch array is arranged in a grid;

wherein the antenna patch array comprises a first antenna patch and a second antenna patch;

wherein the switch array comprises a first switch, a second switch, and a third switch connected between the first antenna patch and the second antenna patch via a different two terminals of the first antenna patch and the second antenna patch;

wherein the first switch is connected between a first edge corner of the first antenna patch and a first edge corner of the second antenna patch;

wherein the second switch is connected between a second edge corner of the first antenna patch and a second edge corner of the second antenna patch; and wherein the third switch is connected between a first mid-edge portion of the first antenna patch and a first mid-edge portion of the second antenna patch.

10. The apparatus of claim 1, wherein the antenna patch array is an N by N phased array, and N by N phased array is defined as a square phased array.

11. The apparatus of claim 1, wherein the control circuitry is further configured to perform analog and digital beamforming via the antenna patch array in both the first communications mode and the second communications mode.

12. The apparatus of claim 1, wherein the control circuitry comprises a digital to analog converter/analog to digital converter (DAC/ADC) that operates in both the first communications mode and the second communications mode.

13. A method comprising:

controlling, via a control circuitry comprising an individually configured antenna configuration controller, states of switches of a switch array to operate an antenna patch array in a first communications mode at a first wavelength, the antenna patch array comprising a plurality of antenna patches and the switch array comprising a plurality of switches, each switch of the plurality switches being electronically controllable by the control circuitry to transition between states comprising a conducting state and a non-conducting state, and each switch being electrically connected between two of the antenna patches of the antenna array; and controlling, via the control circuitry, the states of the switches of the switch array to operate the antenna patch array in a second communications mode at a second wavelength.

14. The method of claim 13, wherein the antenna patches of the antenna patch array are individually sized for millimeter-wave operation; wherein the first wavelength is a millimeter-wave wavelength; and wherein the second wavelength is a centimeter-wave wavelength.

15. The method of claim 13, wherein the antenna patch array comprises a first antenna patch and a second antenna patch;

wherein the switch array comprises a first switch connected between the first antenna patch and the second antenna patch via a first two terminals of the first antenna patch and the second antenna patch;

wherein the method further comprises:

controlling, by the control circuitry, the first switch to be in a non-conducting state in the first communications mode; and controlling, by the control circuitry, the first switch to be in a conducting state in the second communications mode.

16. The method of claim 15, wherein the switch array further comprises a second switch and a third switch; wherein the second switch is connected between the first antenna patch and the second antenna patch via a second two terminals of the first antenna patch and the second antenna patch; and wherein the third switch is connected between the first antenna patch and the second antenna patch via a third two terminals of the first antenna patch and the second antenna patch.

17. The method of claim 16 further comprising: controlling, by the control circuitry, the second switch and the third switch to be in a non-conducting state in the first communications mode; and controlling, by the control circuitry, the second switch and the third switch to be in a conducting state in the second communications mode.

18. The method of claim 17, wherein the antenna patch array further comprises a third antenna patch; wherein the switch array further comprises a fourth switch, a fifth switch, and a sixth switch, each of the fourth switch, the fifth switch, and the sixth switch being connected between the first antenna patch and the third antenna patch via a different two terminals of the first antenna patch and the third antenna patch;

wherein the method further comprises:

controlling, by the control circuitry, the fourth switch, the fifth switch, and the sixth switch to be in a non-conducting state in the first communications mode; and controlling, by the control circuitry, the fourth switch, the fifth switch, and the sixth switch to be in a conducting state in the second communications mode.

19. The method of claim 13, wherein the switches of the switch array comprise radio frequency microelectromechanical systems (RF MEMS) switches, p-type intrinsic n-type (PIN) diodes, or field effect transistors (FETs).

20. The method of claim 13, wherein each antenna patch of the antenna patch array is connectable to two other antenna patches via the switch array.

* * * * *